US005145234A

United States Patent [19]

Gualtierotti et al.

[11] Patent Number: 5,145,234

[45] Date of Patent: Sep. 8, 1992

[54] REVERSIBLY DEFORMABLE FRAME WITH UPPER MEMBERS FLEXIBLE IN ANY DIRECTION AND A LOWER HORIZONTALLY DEFORMABLE BAND FOR THE BACKS OF CHAIRS AND THE LIKE

[75] Inventors: Gianfranco Gualtierotti, Piazza; Alessandro M. D. Stelle, Florence, both of Italy

[73] Assignee: Cassina S.p.A., Meda, Italy

[21] Appl. No.: 543,955

[22] Filed: Jun. 26, 1990

[30] Foreign Application Priority Data

Jun. 28, 1989 [IT] Italy ..... 21013 A/89

[51] Int. Cl.[5] ..... A47C 7/46

[52] U.S. Cl. ..... 297/460; 297/443

[58] Field of Search ..... 297/284 R, 443, 460, 297/452

[56] References Cited

U.S. PATENT DOCUMENTS 4,066,295 1/1978 Severson ..... 297/443

4,309,058 1/1982 Barley ..... 297/284

4,367,897 1/1983 Cousins ..... 297/284

FOREIGN PATENT DOCUMENTS 11017 3/1905 United Kingdom ..... 297/460

*Primary Examiner*—Peter R. Brown

*Attorney, Agent, or Firm*—Herbert Dubno

[57] ABSTRACT

A reversibly deformable frame for the backs of sofas, settees, divan beds and the like comprising a set of rod-shaped members with a vertical axis which can be deformed in any direction placed parallel in a vertical direction and integral with a base having rigid members placed in the vertical direction hinged together and forming a band which can be arched in the horizontal direction, the upper vertical part of the said frame comprising uprights formed from deformable rod-shaped members with a lower rigid part integral with the said band, the entire frame assembly being capable of being fixed to the seat of the sofa or settee to which the back is fitted by means of outer uprights which can be inserted into suitable supports.

2 Claims, 3 Drawing Sheets

REVERSIBLY DEFORMABLE FRAME WITH UPPER MEMBERS FLEXIBLE IN ANY DIRECTION AND A LOWER HORIZONTALLY DEFORMABLE BAND FOR THE BACKS OF CHAIRS AND THE LIKE

DESCRIPTION

This invention relates to a deformable frame for the backs of sofas, settees, divan beds and the like.

THE RELATED ART

Various types of frames are known in the art for use within the upholstery of the backs and seats of armchairs and settees. These frames have mechanisms whereby the relative position between back and seat can be varied or whereby the position of one part of the back can be varied with respect to another, for example the position supporting the shoulders, back or head with different inclinations, or to raise or lower the curvature of the back, thus also varying the overall conformation of the back itself in any desired manner.

However all these mechanisms have many technical limitations. For instance, they can only assume individual mechanically predetermined positions which can be achieved by means of discontinuous movements and stoppage and locking in the final position, with a consequent need for unlocking and a search for the correct position when returning to the original conformation.

Such mechanisms are also formed by many parts which interact together mechanically, which are subject to wear and are therefore difficult to maintain, given that it is necessary to insert them within the upholstery of the settee.

Also they do not allow the user to make free changes in the initial shape of the settee provided by the manufacturer, in accordance with need and taste, altering the various component members such as the seat, back and/or arms and their relative positions.

There is therefore a technical problem of constructing a back for settees and the like provided with a frame which is capable of being deformed in a reversible manner, with continuous movement according to free-bending trajectories which also allow the relative movement of points on the same member which it is desired to deform, such as for example two outwardly bent extremities of a back. Also there is the problem that the frame itself should be formed of mechanical parts which do not require maintenance, which are of low cost and which are easy to install within the upholstery of settees and the like, without damaging the upholstery itself in the course of time, while at the same time ensuring maximum comfort to the user.

These technical problems are resolved by a reversibly deformable frame for the backs of sofas, settees, divan beds and the like which comprises a series of rod-shaped members which have vertical axes deformable in any direction, parallel in the vertical direction and integral with a base with rigid members placed in a vertical direction connected together by means of hinges and forming a band which can be arched in the horizontal direction, the upper vertical part of the frame being formed of uprights constructed from deformable rod-shaped members having a lower rigid part integral with the band, the entire frame being capable of being attached to the seat of the sofa or settee to which the back is fitted by means of outer uprights insertable into suitable supports.

The band which can be arched in a horizontal direction is formed of plate-like members which are hinged together and integral at the centre with hollow members capable of receiving the axially deformable rod-shaped members.

It is also provided that in the frame according to the invention the band which can be arched horizontally should consist of axially rigid tubular members which are attached together by means of chain links and hinges between which is inserted a friction material. The friction level should be adjusted by means of operating a screw whose threaded extremity projects above the tubular members and is capable of engaging a nut made in the lower end of the deformable rod. Thereby coupling is achieved between the rod and band and simultaneous adjustment of the stiffness of the hinge by means of greater or lesser tightening of the friction material.

Also in the frame according to the invention the outer uprights of the band have a rigid lower part which can serve as an integral back and seat of the settee or the like by insertion into holes or guides constructed in the seat itself and an upper rod part having a deformable axis with greater rigidity than the other rod-shaped members.

In a variant frame according to the invention there are upper horizontal deformable bands extending between the outer rigid members capable of assuming an outwardly arched position and a horizontal band formed from flat vertical members connected together by means of hinges capable of adopting the same curvature as the upper part of the frame.

BRIEF DESCRIPTION OF THE DRAWINGS

These and other characteristics will become clear from the embodiments described below with reference to the drawing in which.

DETAILED DESCRIPTION

Figure 2:
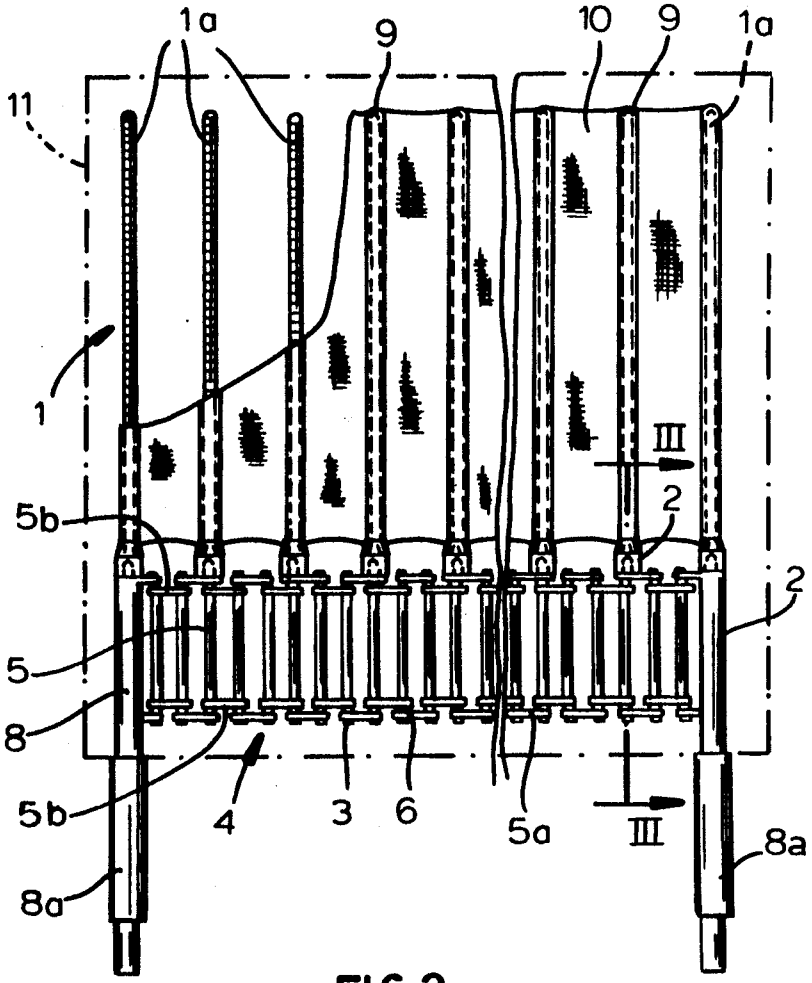
FIG. 2 shows a frontal view of the frame in FIG. 1.
Figure 1:
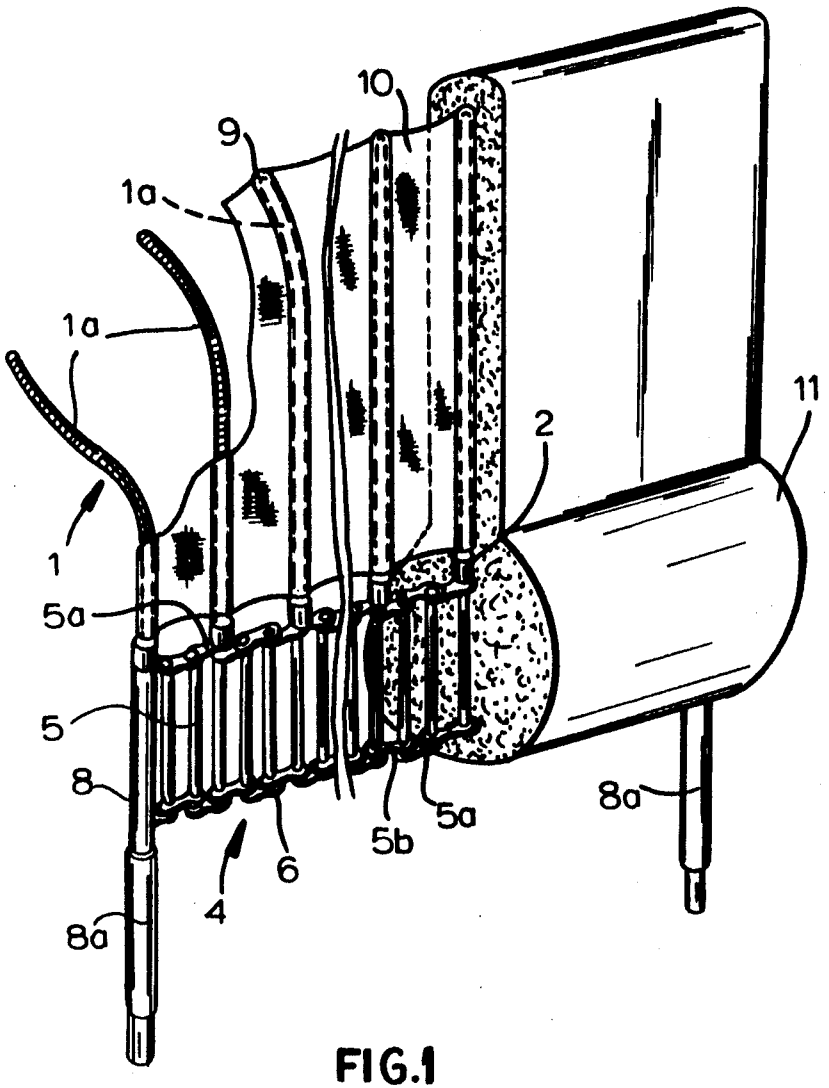
FIG. 1 shows a perspective view of a frame according to the invention partly covered by the corresponding upholstery to produce a deformable back.
Figure 3:
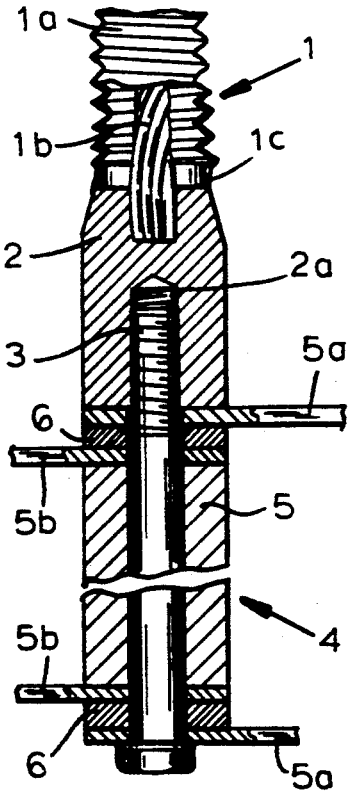
FIG. 3 shows a cross-section along the line III—III in FIG. 2.

With reference to FIGS. 1, 2 and 3, the frame substantially comprises a plurality of rod members 1 formed of a flexible spiral 1*a* of preferably metal material within which may be contained a core 1*b* of thread-like or spirally wound high-friction material, such as cord or the like, or a round soft metal core, so as to render rod 1 radially deformable in any direction chosen at will, but which at the same time has sufficient rigidity to bending under the force exerted by the supported user's back to hold its preselected position.

The lower end 1*c* of the rod is made integral with a sleeve 2 which has internally a nut 2*a* capable of accepting the threaded end of a screw 3. Rod 1 through the screw connection is integral with a band, generically indicated by 4 and consisting in the example of a set of axially rigid tubular members 5 connected together by means of chain members 5a, 5b forming hinges with inserted adjustable friction members 6 providing deformability to band 4 in the horizontal but not vertical direction. Screw 3, inserted in tubular member 5, is screwed to nut 2a securing rod 1 to band 4. Simultaneously with fastening, the screw adjusts the stiffness of the hinge by greater or lesser tightening of friction member 6 constructed of friction material and placed between the links of the chain.

The frame is completed by two rigid outer uprights 8 to which band 4 is firmly attached. These uprights 8 can support the entire frame by means of extensions 8a, which when inserted in holes or slide guides which are in themselves known and are made in the base of the sofa or settee render the frame integral with the base.

Each rod 1 is also preferably covered with a protective fabric sheath 9 which avoids damage to the upholstery of the back, the individual sheaths being connected together by means of an elastic fabric 10 which permits the rods to move apart following changes in shape and at the same time provides a better distribution of the pressure on and between rods 1 providing greater overall continuity of support.

The frame is subsequently covered by or inserted into upholstery 11 of deformable material as illustrated in FIG. 1, and only the lower parts 8a of the two uprights 8 project therefrom.

Figure 4:
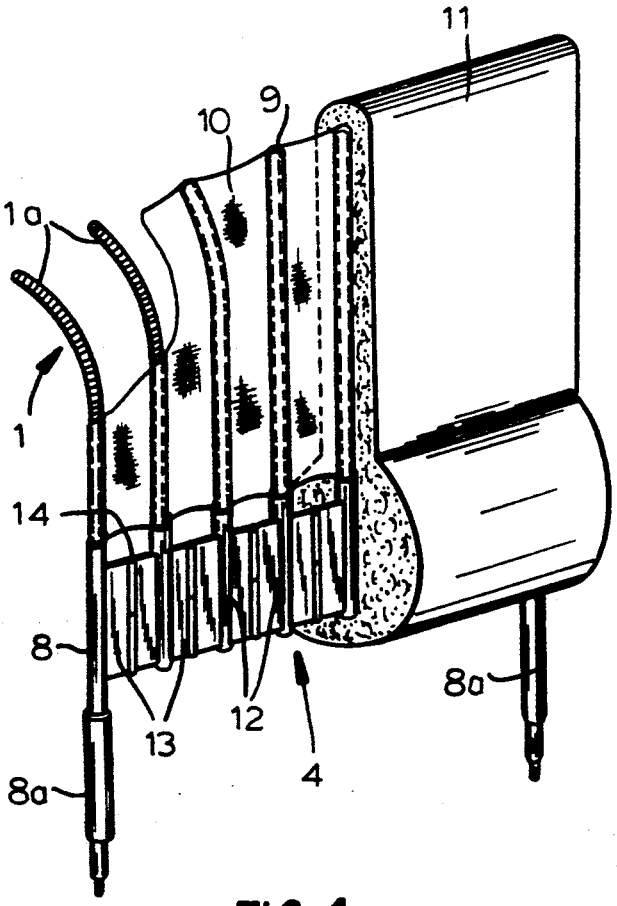
FIG. 4 shows an example of a variant of the lower axially rigid part of the frame.

FIG. 4 illustrates a variant embodiment of band 4 which in this case is formed from hollow cylindrical members 12 into each of which is inserted rod 1 integral with flat plates 13 which are connected together by means of hinges 14 which allow relative curvature movement in the horizontal direction.

Figure 5:
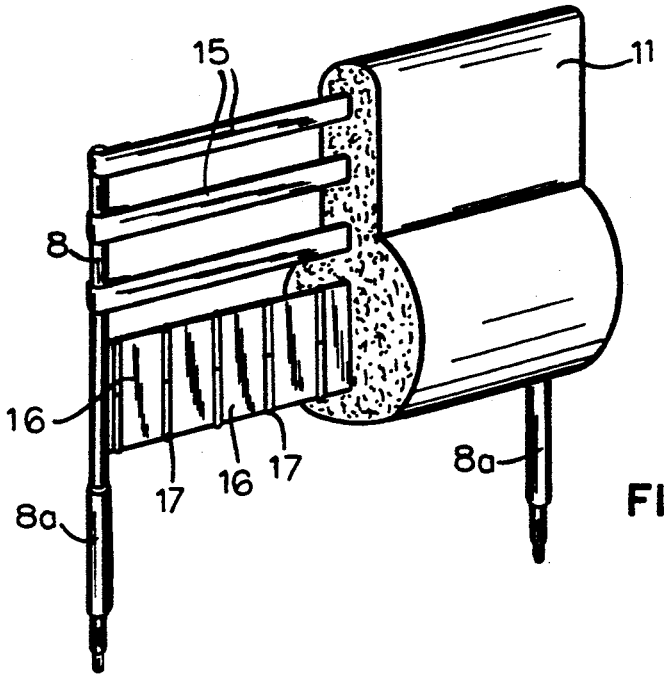
FIG. 5 shows an example variant of the upper part of the frame in FIG. 1, FIGS. 6*a*, *b*, *c* and *d* show some examples of possible deformations which can be achieved with the frame according to the invention.
Figure 6A:
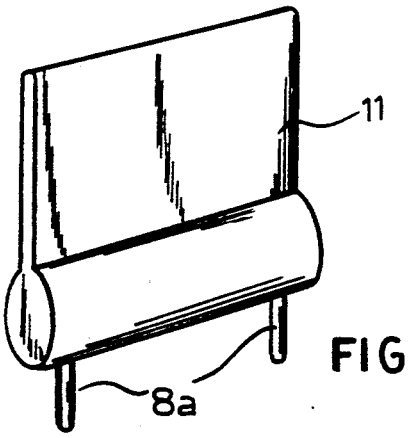
Figure 6B:
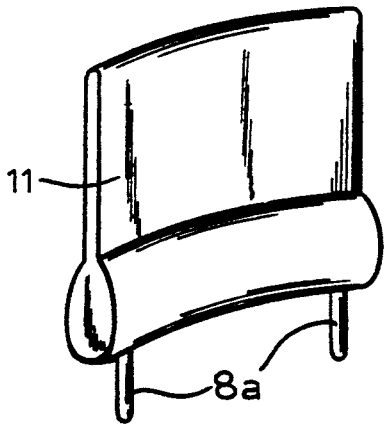
Figure 6C:
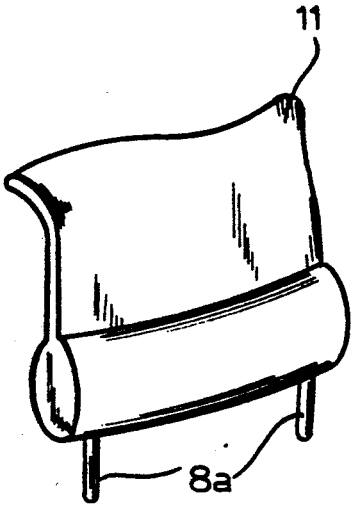
Figure 6D:
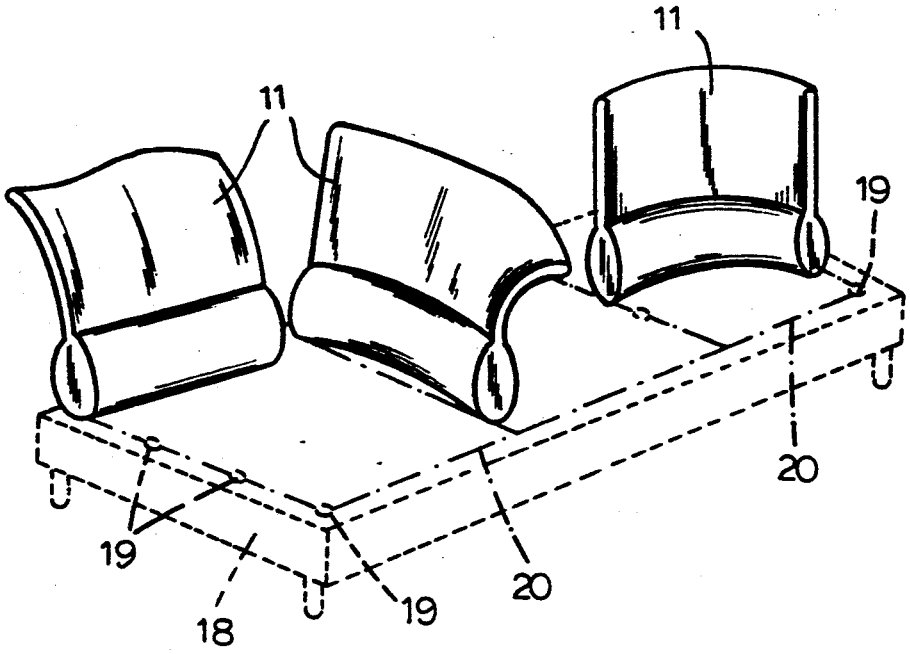

A further embodiment is illustrated in FIG. 5 in which the vertical rods consist of strips 15 which join together the two outer uprights 8 which in this case are rigid to the full height of the back. A simplified form of deformable frame for settees thereby is achieved in which only deformation in the direction of curvature is permitted, with concavity towards the interior of the seat, and therefore only with mutual approach of the outer uprights which must be inserted into corresponding slide channels or alternatively into correspondingly spaced holes in the base as illustrated diagrammatically in FIG. 6d and described below.

In a further simplified form (FIG. 5), lower band 4 may in addition to the bands already described with reference to FIGS. 1 and 4 also be formed from a set of flat rigid plates 16 connected together by means of hinge 17 which can also assume the curvature of the upper part of the back.

FIG. 6 diagrammatically illustrates various positions which can be adopted by the back according to the invention. In particular, FIG. 6a shows the back in an erect position, FIG. 6b shows curvature in a horizontal direction, FIG. 6c shows the ends bent backwards in an asymmetric way and FIG. 6d shows an assembly of various backs on a settee base 18 having a plurality of channels 20 with an upper opening allowing sliding, or alternatively a plurality of holes 19 (indicated by a dashed line in FIG. 6d) in which the ends 8a of uprights 8 can be inserted so as to make the back adopt various different positions and forms.

It is obvious that many variants may be made to the frame according to the invention particularly as regards the selection of materials and the construction of the hinges of the lower supporting band without thereby going beyond the scope of this invention.

We claim:

1. A reversibly deformable frame for the backs of upholstered furniture comprising:

a support member;

a plurality of uprights mounted on said support member;

a plurality of deformable rod-shaped members flanked by said uprights and operatively connected therewith, each of said deformable members having a vertical axis in a rest position and being individually deformable in any direction along said axis upon a load;

a band formed of units extending between and connected to said uprights and comprising a plurality of parallel rigid members oriented in a vertical direction and operatively connected with said plurality of rod-shaped members;

a plurality of chain links mounted on and connecting said rigid members with one another; and a plurality of hinges provided with frictional material for connecting said chain links with one another, so that said rigid members are capable of maintaining a position corresponding to one chosen by a user and different from said rest position.

2. The frame defined in claim 1, further comprising a plurality of screws each having a threaded end, said end projecting upwardly from the respective rigid member, and a plurality of screws receiving elements mounted on a lower extremity of the respective deformable rod member, said screws and screw receiving elements coupling with one another thereby joining said rods and band, and said screws functioning to adjust stiffness of hinge friction by means of tightening said friction material.

* * * * *